US007803216B2

(12) United States Patent
Koyama et al.

(10) Patent No.: US 7,803,216 B2
(45) Date of Patent: Sep. 28, 2010

(54) PRESSURIZED HIGH-TEMPERATURE GAS COOLER

(75) Inventors: Yoshinori Koyama, Nagasaki (JP); Katsuhiko Yokohama, Nagasaki (JP); Osamu Shinada, Nagasaki (JP); Hiromi Ishii, Minato-ku (JP); Yuichiro Kitagawa, Nagasaki (JP); Kosei Manabe, Minato-ku (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 949 days.

(21) Appl. No.: 11/643,671

(22) Filed: Dec. 22, 2006

(65) Prior Publication Data

US 2007/0144712 A1 Jun. 28, 2007

(30) Foreign Application Priority Data

Dec. 28, 2005 (JP) ..... 2005-378724

(51) Int. Cl.
*F28F 9/22* (2006.01)
*F22D 1/02* (2006.01)

(52) U.S. Cl. ..... 95/189; 96/193; 96/200; 96/202; 96/213; 261/119.1; 48/67; 48/69; 48/77; 122/5; 122/6 A; 122/7 R

(58) Field of Classification Search ..... 95/189, 95/193, 200, 202, 213; 261/119.1; 48/67, 48/69, 77; 122/5, 6 A, 7 R
See application file for complete search history.

(56) References Cited

U.S. PATENT DOCUMENTS 1,878,176 A * 9/1932 Parker et al. ..... 122/421
2,075,044 A * 3/1937 Lucke ..... 165/101
2,702,235 A * 2/1955 Hochmuth ..... 422/185
2,936,215 A * 5/1960 Hochmuth ..... 423/207
2,983,260 A * 5/1961 Huet ..... 122/32
3,768,447 A * 10/1973 Kallstrand ..... 122/421
3,915,654 A * 10/1975 Oni et al. ..... 422/185
4,031,862 A * 6/1977 Smith ..... 122/421
4,377,132 A 3/1983 Koog et al.
4,479,536 A * 10/1984 Lameris ..... 165/145
4,493,291 A 1/1985 Zabelka
4,739,729 A * 4/1988 Rettemeier et al. ..... 122/476

(Continued)

FOREIGN PATENT DOCUMENTS

JP 57-150791 A 9/1982

(Continued)

*Primary Examiner*—Robert A Hopkins
*Assistant Examiner*—Minh-Chau Pham
(74) *Attorney, Agent, or Firm*—Birch, Stewart, Kolasch & Birch, LLP

(57) ABSTRACT

A compact pressurized high-temperature gas cooler having superior heat exchange performance and excellent economical efficiency is provided. A return-flow structure is formed in which a flue through which high-temperature gas flows is formed in a pressure container, a heat exchanger is disposed in the flue, and a partition dividing the internal cross-sectional area of the flue is provided so that the high-temperature gas supplied from a bottom or a top portion of the pressure container flows back in a return direction. The cross-sectional-area division ratio dividing the internal cross-section of the flue is set so that the flow rate of the high-temperature gas flowing in one direction matches that flowing in the direction opposite thereto.

12 Claims, 8 Drawing Sheets

U.S. PATENT DOCUMENTS

| | | | | |
|---|---|---|---|---|
| 5,230,717 | A * | 7/1993 | Ogawa et al. | 48/76 |
| 5,247,907 | A * | 9/1993 | Lee et al. | 122/1 R |
| 5,769,156 | A * | 6/1998 | Storbacka | 165/145 |

FOREIGN PATENT DOCUMENTS

| | | | |
|---|---|---|---|
| JP | 58-80384 | A | 5/1983 |
| JP | 61207493 | | 9/1986 |
| JP | 61221294 | | 10/1986 |
| JP | 0571602 | U | 9/1993 |
| JP | 3106689 | | 12/1993 |
| JP | 6-30603 | U | 4/1994 |
| JP | 8-231966 | A | 9/1996 |
| JP | 10-298560 | A | 11/1998 |
| JP | 11022905 | | 1/1999 |
| JP | 2006214712 | | 8/2006 |

* cited by examiner

PRESSURIZED HIGH-TEMPERATURE GAS COOLER

BACKGROUND OF THE INVENTION

1. Field of the Invention

The present invention relates to pressurized high-temperature gas coolers, and more particularly, relates to a pressurized high-temperature gas cooler which can be installed in a pressure container, such as a coal gasifier, an oil gasifier, and a biomass gasifier.

This application is based on Japanese Patent Application Nos. 2005-002058 and 2005-378724, the contents of which are incorporated herein by reference.

2. Description of Related Art

In an integrated gasification combined cycle (IGCC) system, for example as shown in FIG. 9, coal gasifier facilities which gasify fuel, such as coal, in a gasifier to produce high-temperature gas have been known.

The coal gasifier facilities include a coal supply device 100, a gasifier 200, a pressurized high-temperature gas cooler (heat exchanger) 300, a char collection device 400, and the like as primary constituent elements.

As shown in FIG. 8, the pressurized high-temperature gas cooler 300 is a device which receives a supply of high-temperature gas (produced gas) at approximately 1,100° C. containing char from the gasifier 200 and then cools the high-temperature gas to approximately 450° C., which is a suitable temperature for a gas purification device (not shown) provided downstream of the gasifier facilities, while simultaneously collecting heat energy from the high-temperature gas. In addition, this pressurized high-temperature gas cooler 300 has a flue 301 which is formed inside a pressure container 350 and which functions as a channel for high-temperature gas, and in the flue 301, heat exchangers; that is, an evaporator (EVA) 310, a secondary superheater (2SH) 320, a primary superheater (1SH) 330, and an economizer (ECO) 340, are disposed in that order from the top, so that cooling is performed by absorbing heat from high-temperature gas flowing in the flue 301 from the top to the bottom.

The structure of a pressurized fluid-bed boiler has been disclosed, for example, in Japanese Unexamined Utility Model Registration Application, Publication No. 5-71602, Japanese Patent No. 3106689, and Japanese Unexamined Patent Application, Publication No. 11-22905.

In the above structure of the related art, that is, in the structure shown in FIG. 8, a high-temperature gas outlet of the flue 301 inside the pressure container 350 provided in the pressurized high-temperature gas cooler 300 is provided at a lower side. In addition, the char collection device 400 connected to the downstream side of this pressurized high-temperature gas cooler 300 is formed so that a high-temperature gas inlet is disposed at an upper side. Accordingly, the length of a produced-gas pipe, which connects between the pressurized high-temperature gas cooler 300 and the char collection device 400, for transporting high-temperature gas cooled in the pressurized high-temperature gas cooler 300 to the char collection device 400 is disadvantageously increased in length in the vertical direction from the high-temperature gas outlet at the lower side to the high-temperature gas inlet at the upper side.

In addition, in the above structure of the related art, since the gas flow rate in the flue 301 is low, heat transfer efficiency is low, and in order to obtain sufficient heat exchange capacity, heat transfer areas necessary for the heat exchangers must be increased; hence, the necessary number of panels formed from heat transfer pipes is increased, and as a result, the cost is inevitably increased. When the heat transfer efficiency is increased, for example, by increasing the gas flow rate, the pressurized high-temperature gas cooler 300 has a long, thin shape since the cross-sectional area of the flue 301 is decreased. This is disadvantageous since the length (height) of the pressure container is excessively increased.

In addition, according to the above related technique, as shown in FIG. 10A, although the cross-section of the pressure container 350 is a circular shape, the cross-section of the flue 301 which is formed inside the pressure container 350 and in which the heat exchangers are provided is a rectangle (regular tetragon); hence, the cross-sectional ratio (cross-sectional area of heat exchanger/cross-sectional area of pressure container) is undesirably low.

According to the circumstances described above, it has been desired to develop a pressurized high-temperature gas cooler which is compact and has superior economical efficiency, which can suppress an increase in length of a pressure container while ensuring the length of a flue necessary for heat exchange, and which can ensure superior heat exchange (cooling) performance while suppressing the degradation in heat transfer efficiency.

BRIEF SUMMARY OF THE INVENTION

The present invention has been conceived in consideration of the above circumstances, and an object of the present invention is to provide a pressurized high-temperature gas cooler having superior heat exchange performance, a compact size, and superior economical efficiency.

To achieve the above object, the present invention provides the following solutions.

A pressurized high-temperature gas cooler according to the present invention comprises a return-flow structure in which a flue through which high-temperature gas flows is formed in a pressure container, a heat exchanger is provided in the flue, and a partition is provided to divide an internal cross-section of the flue so that the high-temperature gas supplied from a bottom portion or a top portion of the pressure container flows back in a return direction. In the above pressurized high-temperature gas cooler, a cross-sectional-area division ratio at which the internal cross-section of the flue is divided is set so that flow rates of the high-temperature gas in opposite directions substantially match each other.

According to the pressurized high-temperature gas cooler described above, forming the return-flow structure in which the partition dividing the internal cross-sectional area of the flue formed in the pressure container is provided so that supplied high-temperature gas flows back in a return direction, and the cross-sectional-area division ratio at which the internal cross-section of the flue is divided is set so that the flow rates of the high-temperature gas in opposite directions substantially match each other can decrease the required heat transfer area by suppressing a decrease in the flow rate, and in addition, the length (height) of the pressure container can be shortened (reduced).

In the above pressurized high-temperature gas cooler, the return-flow structure is preferably formed so that high-temperature gas supplied from a gas inlet provided at a top portion of the pressure container flows back and out through a gas outlet provided at an upper portion and so that the length of a produced-gas pipe, which connects the gas outlet and a gas inlet of a char collection device provided above the pressurized high-temperature gas cooler, is shortened as much as possible.

In the pressurized high-temperature gas cooler described above, the above return-flow structure is preferably formed so that the cross-sectional-area division ratio of a gas descending portion in which supplied high-temperature gas flows from the top to the bottom is larger than that of a gas ascending portion in which high-temperature gas which changed its flow direction at the bottom portion of the pressure container flows from the bottom to the top, and as a result, the cross-sectional-area division ratio of the gas descending portion in which high-temperature gas having a relatively higher temperature flows is set larger than that of the gas ascending portion in which high-temperature gas having a lowered temperature flows, so that the flow rates of the high-temperature gas in the opposite directions can be made to match each other. In addition, a high-temperature gas outlet supplying high-temperature gas having a lowered temperature to a subsequent step can be provided at an upper portion of the pressurized high-temperature gas cooler.

In the above pressurized high-temperature gas cooler, at a gas-return portion of the flue, a char separation unit is preferably provided, and by this char separation unit, a load placed on a char separation device provided at a downstream side can be decreased.

In the case described above, as the char separation unit, an enlarged cross-sectional-area portion is preferably provided at the gas-return portion to decrease the gas flow rate, or an inertial separation mechanism is preferably provided at the gas-return portion to enable high-temperature gas to generate inertia.

According to the present invention described above, the pressurized high-temperature gas cooler is configured to have a return-flow structure in which the cross-sectional-area division ratio dividing the internal cross-sectional area of the flue by the partition is set so that the flow rates of the high-temperature gas in opposite directions substantially match each other. As a result, the required heat transfer area can be decreased by suppressing the decrease in the flow rate, and in addition, the length (height) of the pressure container can be shortened (reduced); hence, a compact pressurized high-temperature gas cooler having superior economical properties can be provided.

That is, according to the pressurized high-temperature gas cooler of the present invention, since the heat transfer efficiency is high, the required heat transfer area can be decreased, thus providing an advantage in that the cost can be reduced.

In addition, in the return-flow structure in which the gas outlet of the pressurized high-temperature gas cooler is provided at an upper portion, the length of a produced-gas pipe necessary to transport high-temperature gas from this gas outlet to a gas inlet of a char collection system provided above the pressurized high-temperature gas cooler can be desirably shortened as much as possible.

Furthermore, when the flue and the heat exchanger are formed to have a hexagonal cross-sectional shape, the ratio (cross-sectional ratio) of the cross-sectional area of the heat exchanger to that of the pressure container can be improved as compared to that in the case of a rectangular shape.

The present invention may be applied to a high-temperature gas cooler (heat exchanger) provided in a pressure container, such as a coal gasifier, an oil gasifier, or a biomass gasifier.

DETAILED DESCRIPTION OF THE INVENTION

Figure 1:
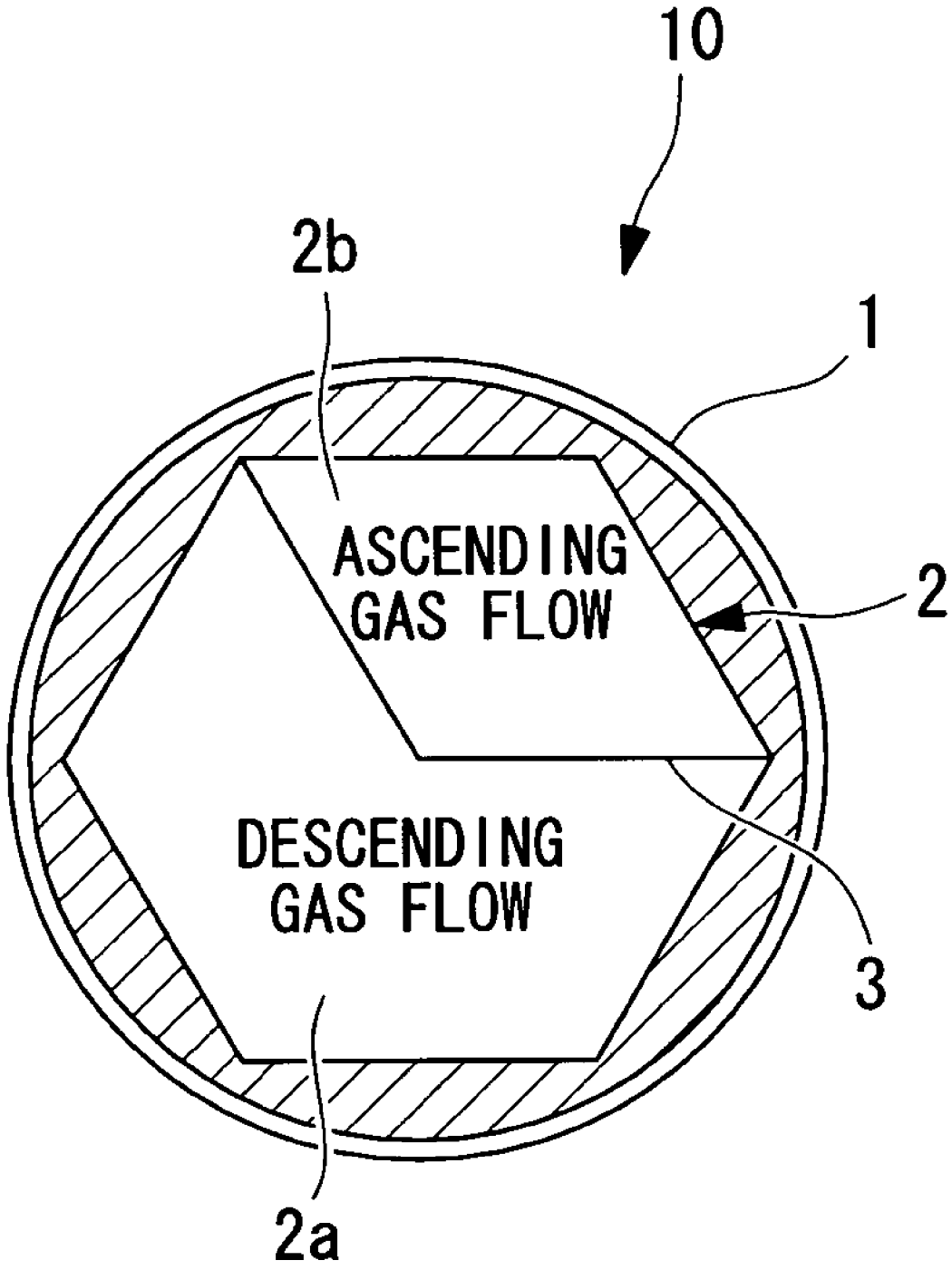
FIG. 1 is a cross-sectional view of a pressurized high-temperature gas cooler of the most preferable embodiment according to the present invention.

The most preferable embodiment for carrying out the present invention is shown in FIG. 1.

A pressurized high-temperature gas cooler 10 has a pressure container 1 having a circular cross-section and a flue 2 having a hexagonal cross-section provided in the pressure container 1; an internal cross-section of this flue 2 is divided by a partition 3 to form a return-flow structure. This return-flow structure has a first flue 2*a* and a second flue 2*b* formed by dividing the flue 2 with the partition 3, and at the bottom or the top portion of the pressure container 1, high-temperature gas (produced gas) supplied from an opposite side thereto (that is, from the top or the bottom portion) changes its flow direction and flows back in a return direction. Hence, the height of the pressure container 1 can be reduced. That is, in the return-flow structure which reduces the height of the pressure container 1, the high-temperature gas may be supplied from either the top or the bottom portion of the pressure container 1.

According to the structural example shown in FIG. 1, for example, a return-flow structure is formed. In the return-flow structure, high-temperature gas is supplied from the top portion of the pressure container 1, and the first flue 2*a* through which the high-temperature gas thus supplied flows from the top to the bottom and the second flue 2*b* through which the high-temperature gas that changed its flow direction at the bottom portion flows from the bottom to the top are provided. In this structure, a cross-sectional-area division ratio between the first flue 2*a* and the second flue 2*b* is set so that the flow rates of the high-temperature gas in opposite directions substantially match each other, and the cross-sectional-area division ratio of the first flue 2*a*, that is, a gas descending portion through which the supplied high-temperature gas flows from the top to the bottom, is set to be larger than that of the second flue 2*b*, that is, a gas ascending portion through which the high-temperature gas that changed its flow direction at the bottom portion of the pressure container 1 flows from the bottom to the top.

In a return-flow-type heat exchanger of the related art, since the cross-sectional area of a high-temperature gas ascending portion and that of a high-temperature gas descending portion are formed to be equal to each other, the gas flow rate at a low-temperature gas portion is decreased, and as a result, the heat transfer efficiency is undesirably degraded.

For example, the first flue 2*a* is formed so as to have a cross-sectional-area division ratio of 2/3, is divided by the partition 3 so as to form an angle of 240° with respect to the center of the flue 2, and is surrounded by six sides which are composed of four sides of a hexagonal-shaped wall of the flue 2 and two sides of the partition 3, the sides facing each other being parallel to each other.

For example, the second flue 2*b* is formed so as to have a cross-sectional-area division ratio of 1/3, is divided by the partition 3 so as to form an angle of 120° with respect to the center of the flue 2, and is surrounded by four sides forming a parallelogram, which are composed of two sides of the partition 3 and two sides of the hexagonal-shaped wall of the flue 2.

That is, the first flue 2*a* and the second flue 2*b* are formed by dividing the flue 2 at a cross-sectional-area division ratio of 2 to 1; however, this cross-sectional-area division ratio may be changed as desired, for example, in accordance with various conditions, such as the temperature of the high-temperature gas.

Figure 10A:
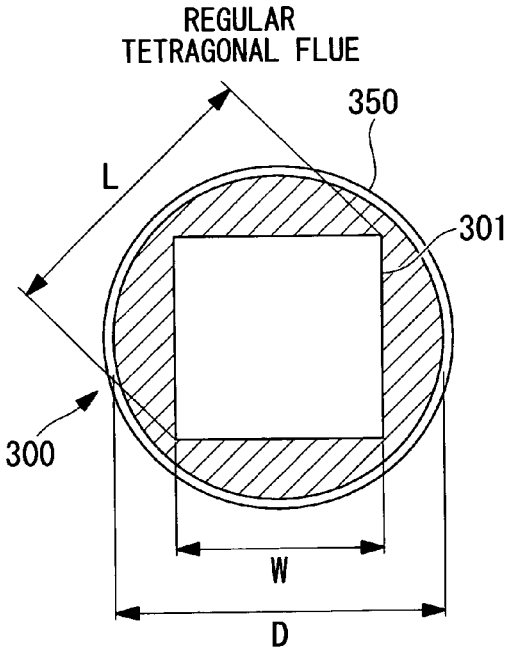
FIGS. 10A and 10B are views illustrating a pressurized high-temperature gas cooler of the related art and that of the present invention in order to compare the cross-sectional ratios.
Figure 10B:
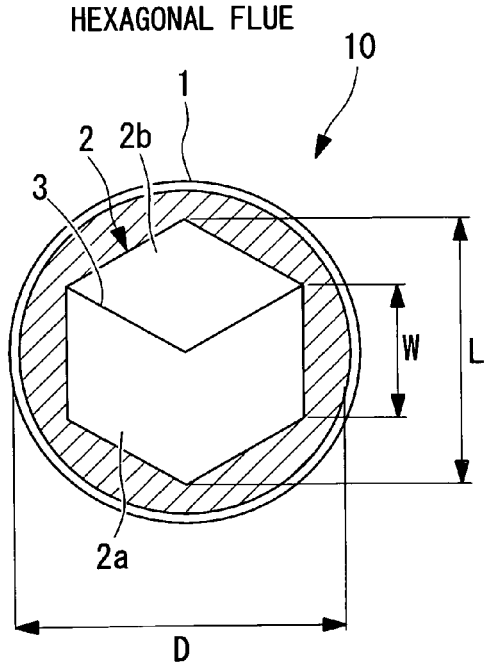

As a result, as shown in FIG. 10B, since the flue 2 is formed so as to have a hexagonal cross-section, it is understand the cross-sectional-area ratio (cross-sectional ratio) of the flue 2 with respect to the cross-sectional area of the pressure container 1, having a circular cross-section, is improved. For example, when a diagonal length L of the flue 2 is set to 5 m, although the cross-sectional ratio of the related structure shown in FIG. 10A is 37%, the cross-sectional ratio can be increased up to approximately 40% with the present invention.

Of course, when the cross-section of the flue 2 has a polygonal shape having a larger number of sides so that the cross-section thereof is closer to the circular cross-section of the pressure container 1, the cross-sectional ratio is further improved; however, when the cross-section is a polygon having a larger number of sides than that of a hexagon, panels (heat transfer surfaces) of the heat exchanger which are accommodated inside the flue 2 inevitably have a complicated shape, and as a result, the manufacturing cost is undesirably increased.

That is, in order to improve the cross-sectional ratio while suppressing an increase in manufacturing costs, the cross-section of the flue 2 most advantageously has a polygonal shape. However, the cross-section of the flue 2 is not limited to a hexagonal shape; in consideration of various circumstances, it may also be formed in a rectangular or a polygonal shape.

First Embodiment

Figure 2:
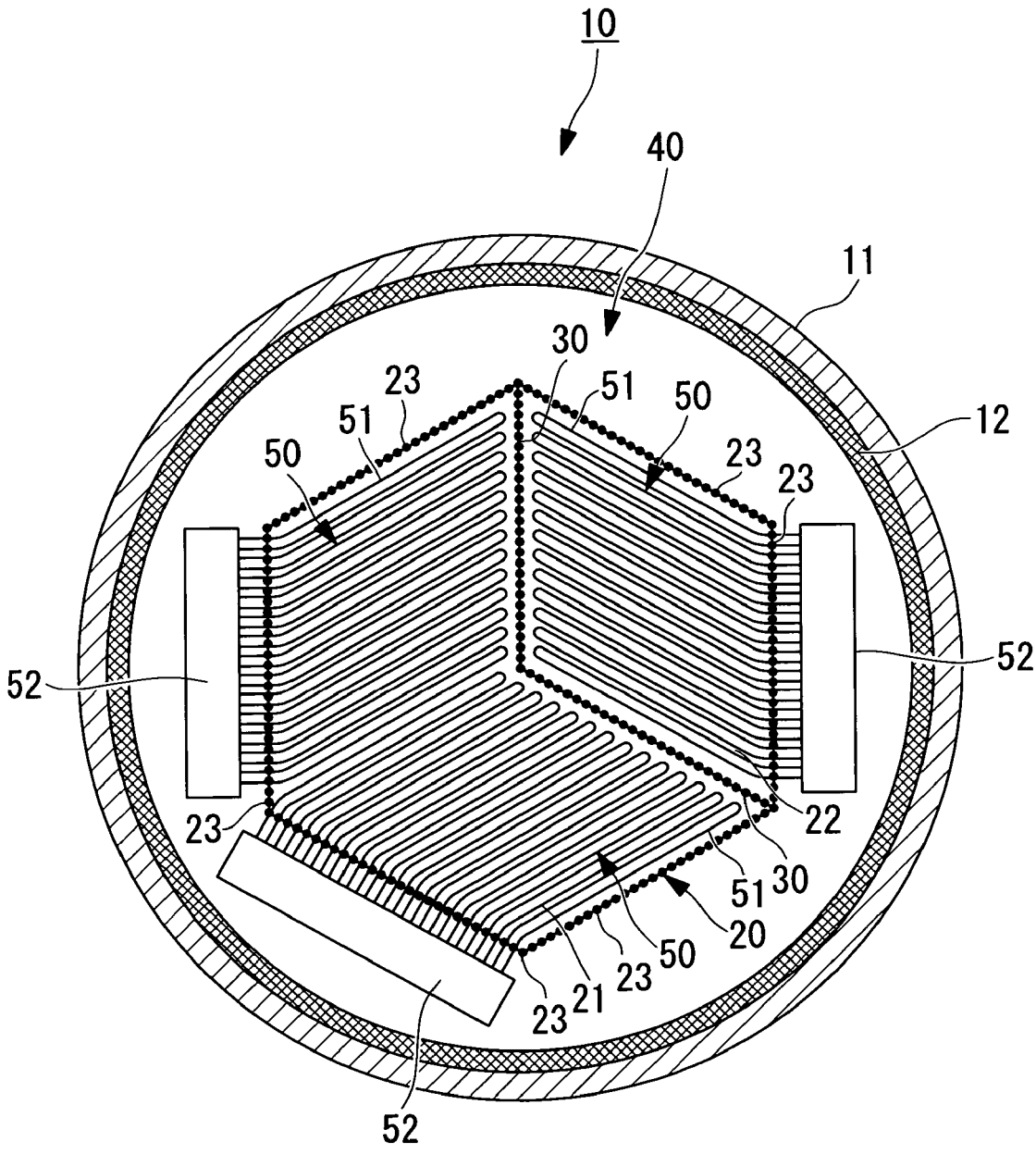
FIG. 2 is a cross-sectional view of a pressurized high-temperature gas cooler of a first embodiment according to the present invention.
Figure 3:
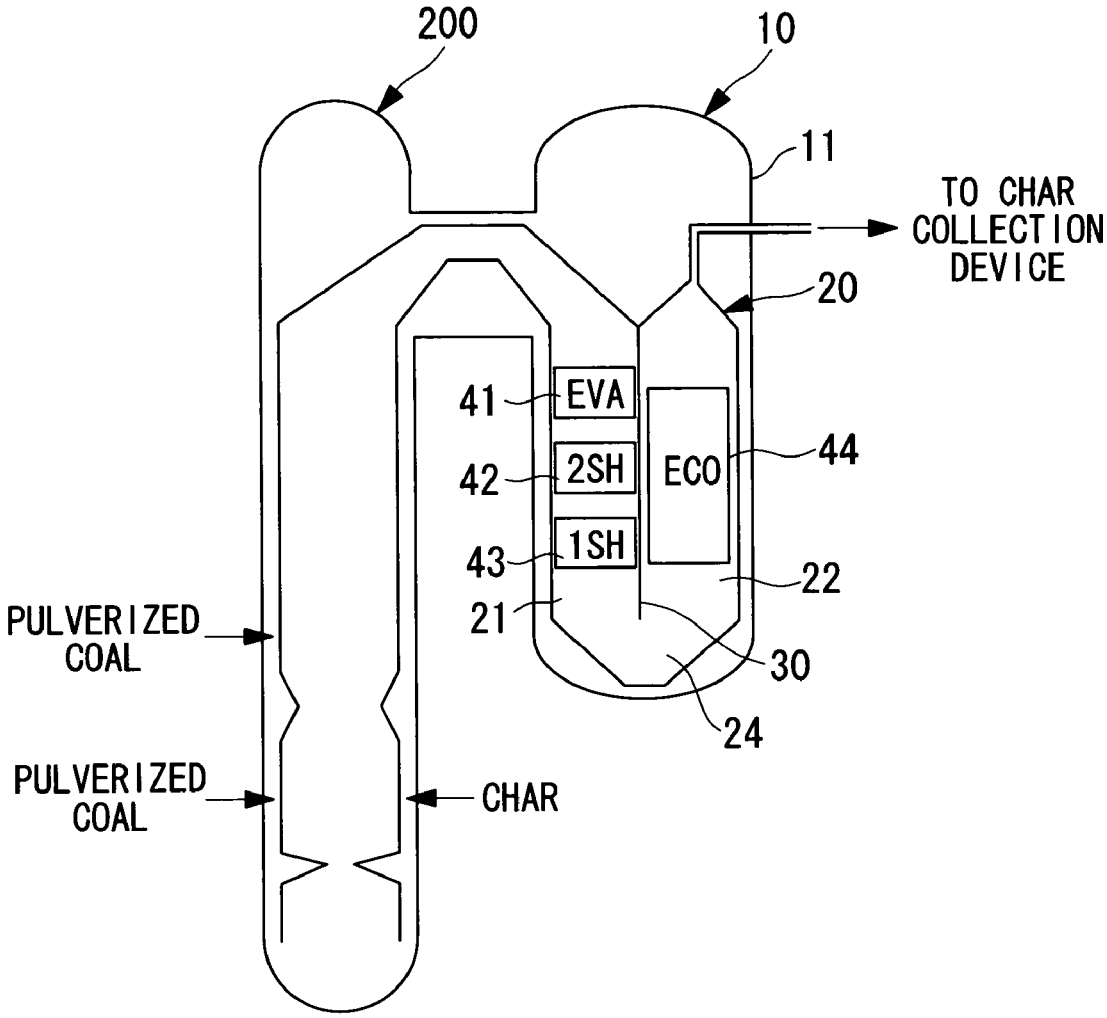
FIG. 3 is a schematic view of an integrated gasification combined cycle system of the first embodiment according to the present invention.

A pressurized high-temperature gas cooler of a first embodiment according to the present invention is shown in FIGS. 2 and 3. In this embodiment, the pressurized high-temperature gas cooler is used in coal gasifier facilities of an integrated coal gasification combined cycle system.

In this embodiment, the pressurized high-temperature gas cooler 10 is a device which receives high-temperature gas at approximately 1,100° C. containing char, produced in the gasifier 200, then cools this high-temperature gas to approximately 450° C. suitable for purification performed in a subsequent step, and at the same time, collects heat energy of the high-temperature gas. A pressure container 11 has an insulating material 12 around the inner circumferential surface thereof, and in a space inside the pressure container 11, a flue 20 having a hexagonal cross-sectional shape is formed. This flue 20 functions as a channel through which high-temperature gas flows and is divided into two portions at a cross-sectional-area division ratio of 2 to 1 by a partition 30. That is, the flue 20 having a hexagonal cross-sectional shape has a return-flow structure composed of two portions, that is, a first flue 21 having a large cross-sectional-area division ratio and a second flue 22 having a small cross-sectional-area division ratio.

In addition, in the first flue 21 and the second flue 22, panels 50 through which a cooling medium flows are provided to form a heat exchanger 40.

In the first flue 21, that is, in a descending portion in which high-temperature gas flows from the top to the bottom, for example, as shown in FIG. 3, an evaporator (EAV) 41, a secondary superheater (2SH) 42, and a primary superheater (1SH) 43 are provided from the top in that order to serve as the heat exchanger 40. In addition, in the second flue 22, that is, in an ascending portion in which high-temperature gas, which changed its flow direction at the bottom surface, flows from the bottom to the top, an economizer (ECO) 44 is provided to serve as the heat exchanger 40. That is, the return-flow structure described above is designed so that high-temperature gas supplied from a gas inlet provided at the top portion of the pressure container changes its flow direction upward and flows out through a gas outlet provided at an upper portion.

In the above structure, for example, the panel 50 of the heat exchanger 40 is formed of approximately U-shaped cooling-medium pipes 51, which are made of steel or the like, through which a cooling medium flows back and forth, and which are regularly disposed on a substantially planar surface, and in addition, the two ends of the cooling-medium pipe 51 are connected to a cooling-medium inlet portion and an outlet portion of a manifold 52, respectively. Accordingly, when the panel 50 is received at an appropriate position of the flue 20, the surface of the cooling-medium pipe 51 functions as a heat-transfer surface, and the cooling medium circulating inside the pipe 51 absorbs heat from the high-temperature gas flowing inside the flue 20, thus forming the heat exchanger 40 which performs cooling of high-temperature gas and collects heat therefrom.

In the embodiment shown in the figure, the cross-sectional-area division ratio of the first flue 21 is set to 2/3. This first flue 21 is obtained by dividing the flue 20 with the partition 30 so as to form an angle of 240° with respect to the center of the flue 20. As a result, the first flue 21 is surrounded by six sides composed of two sides of the partition 30 and four sides of a hexagonal-shaped wall 23 forming the flue 20, the sides facing each other being parallel to each other.

On the other hand, the cross-sectional-area division ratio of the second flue 22 is set to 1/3. This second flue 22 is obtained by dividing the flue 20 with the partition 30 so as to form an angle of 120° with respect to the center of the flue 20. As a result, the second flue 22 is surrounded by four sides of a parallelogram, which are composed of two sides of the partition 30 and two sides of the hexagonal-shaped wall 23 forming the flue 20.

When the inside of the flue 20, having a hexagonal cross-sectional shape, is divided into two portions at a cross-sectional-area division ratio of 2 to 1 by the partition 30, as described above, the panels 50 disposed in the first flue 21 and the second flue 22 may be formed by a combination of panels having the same shape. That is, since two parallelograms, one of which is used in the second flue 22, can be collectively fitted in the first flue 21, three panels 50 having the same shape may be prepared, and by mass production of the panels, the manufacturing cost can be reduced.

Figure 8:
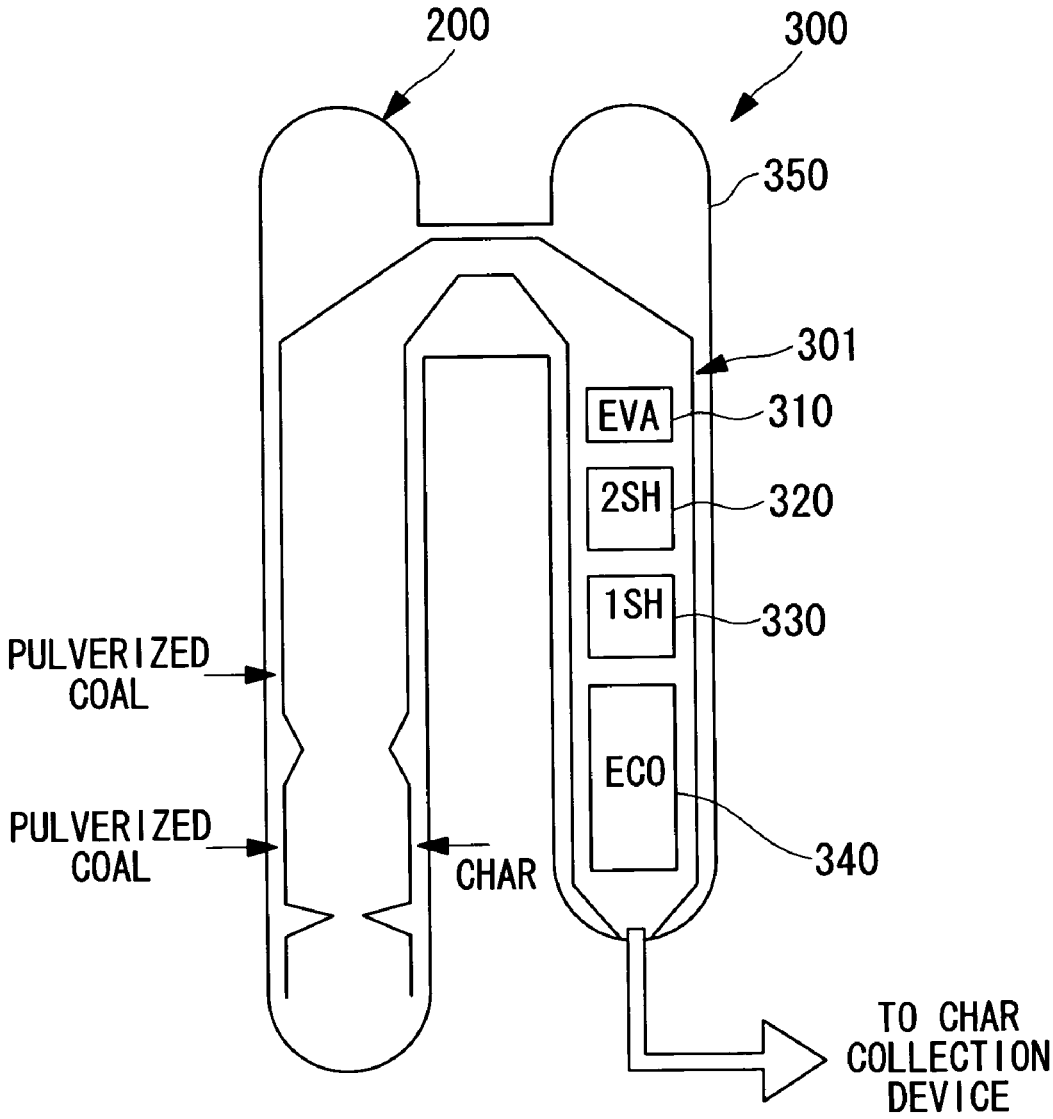
FIG. 8 is a schematic view of an integrated coal gasification combined cycle system according to a related technique.
Figure 9:
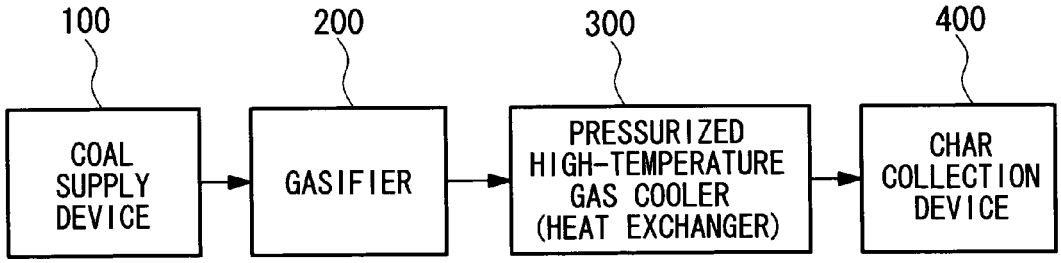
FIG. 9 is a flowchart of coal gasifier facilities of an integrated coal gasification combined cycle system.

In addition, in this embodiment, the return-flow structure is used. In this structure, high-temperature gas supplied from an upper portion of the first flue 21 flows downward therethrough, then changes its flow direction at the bottom surface, and flows upward through the second flue 22 for cooling the high-temperature gas; hence, compared to the related structure in which heat exchangers are arranged in series, as shown in FIG. 8, the height of the pressure container can be reduced, that is, it can be reduced in size, and from this point of view, the cost can be advantageously reduced.

In addition, since the gas outlet of the pressurized high-temperature gas cooler 10 is provided at the upper portion, the length of the produced-gas pipe, which transports high-temperature gas to a gas inlet of a char collection device provided above the pressurized high-temperature gas cooler 10, can be shortened, particularly, in the vertical direction.

Furthermore, as for the cross-sectional-area division ratio between the first flue 21 and the second flue 22, since the ratio of the second flue 22, which is a low-temperature gas portion, is small, the gas flow rate can be increased, and the gas flow rate at a descending gas inlet is made approximately equivalent to that at an ascending gas inlet. That is, since the cross-sectional-area division ratio between the first flue 21 and the second flue 22 is set so that the flow rate of an ascending high-temperature gas matches that of a descending high-temperature gas, the cross-sectional area of the second flue 22 through which high-temperature gas cooled in the first flue 21 flows is set to be small. Hence, by increasing the gas flow rate in the second flue 22 to increase the heat transfer efficiency, the required heat transfer area of the panel 50 can be decreased.

In particular, an inlet gas temperature of gas supplied from an upper portion of the first flue 21, which is the gas descending portion, is 1,100° C., an inlet (position at which the descending gas is changed to the ascending gas) gas temperature of gas flowing upward from a lower end portion of the second flue 22, which is the gas ascending portion, is 550 to 600° C., and an outlet gas temperature at an upper portion of the second flue 22 is 450° C. Hence, although the second flue 22, which is the gas ascending portion, is a low-temperature gas portion, and the volume of high-temperature gas is decreased by cooling, since the cross-sectional area of the second flue 22 is set to be half of that of the first flue 21, which is the gas descending portion, the flow rate is not decreased, and as a result, the flow rate of the ascending gas and that of the descending gas at the respective inlets substantially match each other, which is beneficial.

For example, since the cross-sectional area of a flue was not changed from the inlet to the outlet thereof in the past, as the gas temperature decreases, the flow rate decreases to 1/2. In general, since the heat transfer efficiency of a tube bank is represented by 0.6 orders of magnitude of the Re number (flow rate×representative length/dynamic coefficient of viscosity), the heat transfer efficiency is increased by approximately 1.2 times, and in addition, since the cross-sectional-area efficiency is 40%/37%, that is, is increased by approximately 1.1 times, as a result, the heat transfer efficiency is increased by approximately 1.3 times.

As described above, in this embodiment, since the heat exchanger 40 is formed to have a hexagonal cross-sectional shape, and in addition, the partition 30 is provided so as to divide the hexagonal cross-sectional area at a cross-sectional-area division ratio of 2 to 1, the cross-sectional ratio can be further improved. In addition, since the return-flow structure for cooling is formed, in which high-temperature gas is supplied from the upper portion of the pressurized high-temperature gas cooler 10, flows downward in the first flue 21, which has a cross-sectional-area division ratio of 2/3, changes its flow direction at the bottom portion in a return direction, and then flows upward in the second flue 22, which has a cross-sectional-area division ratio of 1/3, while suppressing an increase in height of the pressure container, the flow rate can be increased and the heat transfer efficiency can be improved.

Second Embodiment

Figure 4:
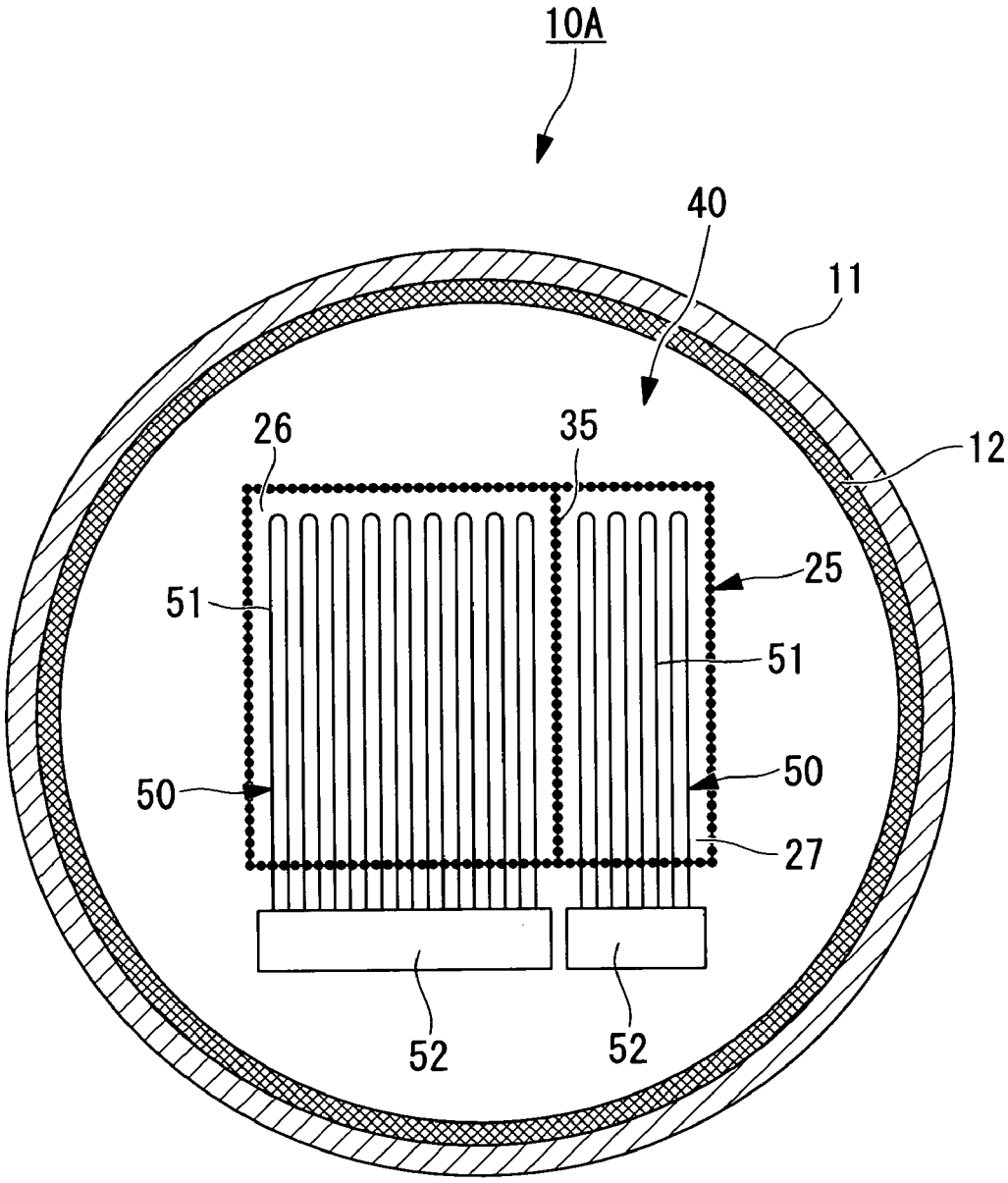
FIG. 4 is a cross-sectional view of a pressurized high-temperature gas cooler of a second embodiment according to the present invention.

FIG. 4 shows a pressurized high-temperature gas cooler 10A of a second embodiment according to the present invention. In this embodiment, the pressurized high-temperature gas cooler 10A is used in coal gasifier facilities of an integrated coal gasification combined cycle system. The same reference numerals as in the above first embodiment designate the same constituent elements in this embodiment, and detailed descriptions thereof are omitted.

In this embodiment, instead of the flue 20 having a hexagonal cross-sectional shape, a flue 25 having a rectangular cross-sectional shape is used. In the embodiment shown in the figure, a partition 35 is provided to divide the flue 25 into two portions, so that a return-flow structure which has a first flue 26 and a second flue 27 at a cross-sectional-area division ratio of 2 to 1 is formed. In this embodiment, the first flue 26 and the second flue 27 are formed by dividing one side of the rectangle at a ratio of 2 to 1.

According to the structure described above, the panels 50 disposed inside the first flue 26 and the second flue 27 can use cooling-medium pipes 51 having a long straight portion as compared to that of the flue 20 having a hexagonal cross-sectional shape formed inside the pressure container 11 having the same diameter. Hence, the number of cooling-medium pipes 51 can be decreased, and although the cross-sectional ratio is slightly degraded, the number of steps in manufacturing, such as bending of the cooling-medium pipes 51 and connection thereof to the manifold 52, can be decreased, and hence manufacturing can be performed at reasonable cost.

In the embodiment shown in the figure, the panel 50 for the first flue 26 and the panel 50 for the second flue 27 are different from each other in size; however, also in this case, when the panel 50 provided for the second flue 27 is formed as a standard type, and these two standard panels 50 are used for the first flue 26, the standard panels 50 can be commonly used for both the first flue 26 and the second flue 27.

Third Embodiment

Figure 5:
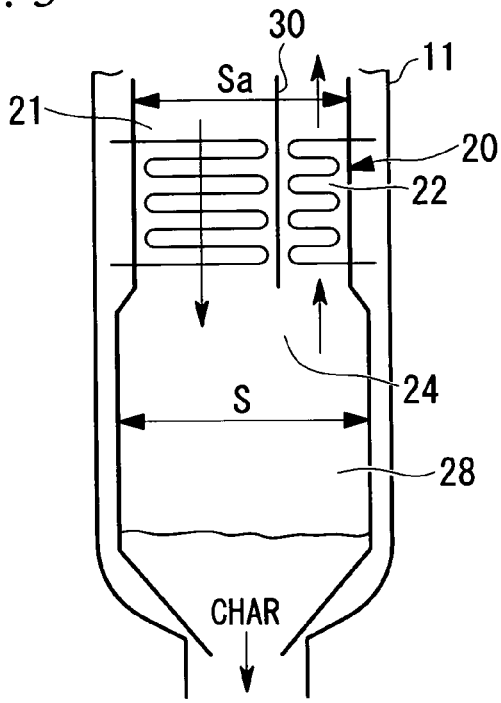
FIG. 5 is a cross-sectional view of the principal part of a pressurized high-temperature gas cooler of a third embodiment according to the present invention.
Figure 6:
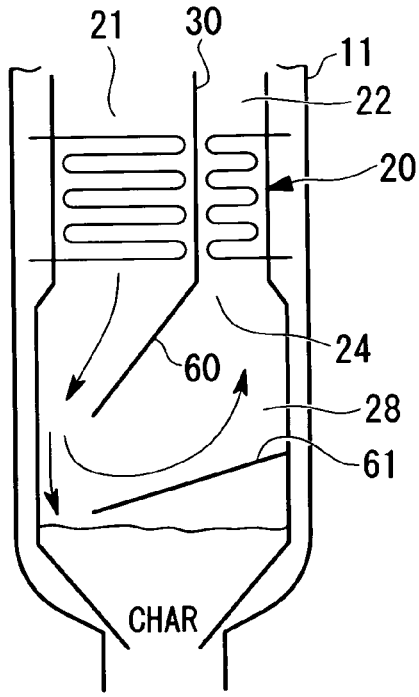
FIG. 6 is a cross-sectional view of the principal part of a first modification of the third embodiment shown in FIG. 5.
Figure 7:
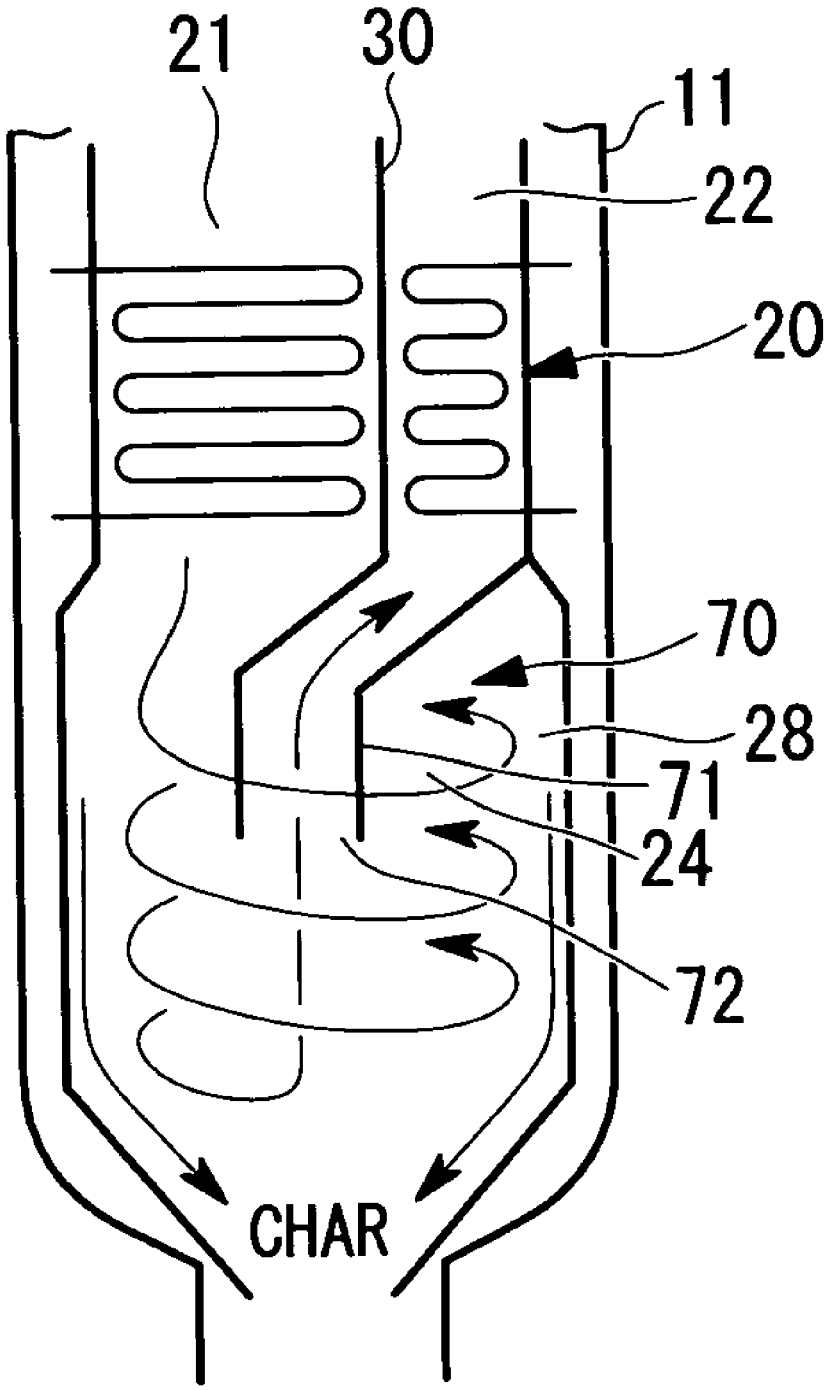
FIG. 7 is a cross-sectional view of the principal part of a second modification of the third embodiment shown in FIG. 5.

The principal portion (bottom portion) of a pressurized high-temperature gas cooler of a third embodiment according to the present invention is shown in FIGS. 5 to 7. In this embodiment, the pressurized high-temperature gas cooler is used in coal gasifier facilities of an integrated coal gasification combined cycle system. The same reference numerals as in the above first and second embodiments designate the same constituent elements in this embodiment, and detailed descriptions thereof are omitted.

In this embodiment, at a gas-return potion at which two portions of the flue 20 divided by the partition 30 communicate with each other, a char separation unit roughly separating char contained in high-temperature gas is provided.

The char separation unit shown in FIG. 5 corresponds to an enlarged cross-sectional-area portion 28 having a cross-sectional area S which is formed by enlarging a gas-return portion 24 of the flue 20. This enlarged cross-sectional-area portion 28 is formed to have the cross-sectional area S larger than a total cross-sectional area Sa in an upper region in which the first flue 21 and the second flue 22 are formed, and hence, when high-temperature gas flows into this enlarged cross-sectional-area portion 28 from the first flue 21, the flow rate is decreased due to the increase in cross-sectional area of the channel. Accordingly, when the flow direction is changed from the descending flow direction to the ascending flow direction, char, which has a large mass, is separated from the high-temperature gas flowing upward because of the decrease in flow rate, falls downward, and is then collected. Hence, char contained in the high-temperature gas fed from the pressurized high-temperature gas cooler can be roughly separated, so that the amount of char is decreased; hence, the load placed on a char collection device provided at a downstream side to thoroughly remove char contained in high-temperature gas can be decreased.

Char separation units shown in FIGS. 6 and 7 are modifications in which an inertial separation mechanism is provided at the gas-return portion 24 of the flue 20. This inertial separation mechanism is a mechanism in which inertia generated by the flow of high-temperature gas is effectively used to roughly separate a gas component (primarily formed of produced gas) from a particle component (primarily formed of char), so that the amount of char fed to a subsequent step is decreased.

In the inertial separation mechanism of a first modification shown in FIG. 6, a tilted plate 60 is provided at a lower end of the partition 30 so as to decrease the cross-sectional area of an outlet of the first flue 21. This tilted plate 60 gradually decreases the cross-sectional area of the flow channel of the high-temperature gas flowing in the first flue 21 and, at the same time, guides the flow of high-temperature gas towards the wall side of the flue 20.

As a result, since the flow rate of the high-temperature gas is temporarily increased, large outward inertia acts when the descending flow is changed to the ascending flow, and char, which has a large mass, is separated and gathered on the wall side and then falls downward, followed by collection.

Furthermore, besides the tilted plate 60, a baffle 61 may also be provided for guiding the high-temperature gas, which changed its flow direction, upward; hence, with this baffle 61, the flow of char towards the wall side is separated, and in addition, char which is separated by the decrease in flow rate after the change in flow direction and which falls downward is guided to the lower side.

In the example shown in the figure, the enlarged cross-sectional-area portion 28 is formed at the gas-return portion and the tilted plate 60 is provided therein; however, the tilted plate 60 may be provided without forming the enlarged cross-sectional-area portion 28.

In the inertial separation mechanism of a second modification shown in FIG. 7, a cyclone 70 is formed at the gas-return portion 24. In this cyclone 70, a gas channel 71 communicating with the second flue 22 is formed, and this gas channel 71 has an inlet opening 72 at a front portion extending approximately to a central position of the flue 20. As a result of forming the cyclone 70, in which high-temperature gas containing char, which flows out from the first flue 21, flows circularly around the gas channel 71, and then flows into the second flue 22 through the inlet opening 72, an inertial force is generated by the circular flow around the gas channel 71; hence, char, which has a large mass, can be separated to the circumferential side. In addition, the char separated to the circumferential side falls downward and is then collected.

In the example shown in the figure, the cyclone 70 is provided at the gas-return portion 24; however, the cyclone 70 may be provided without forming the enlarged cross-sectional-area portion 28.

In the above embodiments, the arrangement of the evaporator (EAV) 41, the secondary superheater (2SH) 42, the primary superheater (1SH) 43, and the economizer (ECO) 44, which function as the heat exchanger 40, is not particularly limited and may be freely changed as desired.

In addition, in the above embodiments, the pressurized high-temperature gas cooler is applied to an integrated coal gasification combined cycle system; however, the present invention is not limited thereto, and for example, may be applied to a high-temperature gas cooler (heat exchanger) provided in a flue formed inside a pressure container, such as a coal gasifier, an oil gasifier, or a biomass gasifier.

Furthermore, the present invention is not limited to the above embodiments; the embodiments may be freely modified as desired without departing from the spirit and the scope of the present invention.

What is claimed is:

1. A pressurized high-temperature gas cooler comprising a return-flow structure in which a flue through which high-temperature gas flows is formed in a pressure container, a heat exchanger is provided in the flue, and a partition is provided to divide an internal cross-section of the flue so that the high-temperature gas supplied from a bottom portion or a top portion of the pressure container flows back in a return direction, wherein a cross-sectional-area division ratio at which the internal cross-section of the flue is divided is set so that flow rates of the high-temperature gas in opposite directions substantially match each other.

2. The pressurized high-temperature gas cooler according to claim 1, wherein the return-flow structure is formed so that high-temperature gas supplied from a gas inlet provided at a top portion of the pressure container flows back and out through a gas outlet provided at an upper portion, and the length of a produced-gas pipe connecting the gas outlet and a gas inlet of a char collection device disposed above the pressurized high-temperature gas cooler is shortened as much as possible.

3. The pressurized high-temperature gas cooler according to claim 1, wherein the return-flow structure is formed so that a cross-sectional-area division ratio of a gas descending portion in which the high-temperature gas flows from the top to the bottom is set to be larger than that of a gas ascending portion in which the high-temperature gas flows back from the bottom to the top.

4. The pressurized high-temperature gas cooler according to claim 2, wherein a char separation unit roughly separating char contained in the high-temperature gas is provided at a gas-return portion of the flue.

5. The pressurized high-temperature gas cooler according to claim 4, wherein the char separation unit is an enlarged cross-sectional-area portion of the gas-return portion.

6. The pressurized high-temperature gas cooler according to claim 4, wherein the char separation unit is an inertial separation mechanism provided at the gas-return portion.

7. The pressurized high-temperature gas cooler according to claim 3, wherein a char separation unit roughly separating char contained in the high-temperature gas is provided at a gas-return portion of the flue.

8. The pressurized high-temperature gas cooler according to claim 7, wherein the char separation unit is an enlarged cross-sectional-area portion of the gas-return portion.

9. The pressurized high-temperature gas cooler according to claim 7, wherein the char separation unit is an inertial separation mechanism provided at the gas-return portion.

10. The pressurized high-temperature gas cooler according to claim 1, wherein the pressure container has a circular cross-section.

11. The pressurized high-temperature gas cooler according to claim 1, wherein the flue having a hexagonal cross-section is provided in the pressure container.

12. The pressurized high-temperature gas cooler according to claim 1, wherein the flue is divided by a partition at a cross-sectional-area division ratio of 2 to 1.

* * * * *